US009574504B2

(12) United States Patent
Kato et al.

(10) Patent No.: US 9,574,504 B2
(45) Date of Patent: Feb. 21, 2017

(54) VEHICLE AND CONTROL METHOD FOR THE VEHICLE

(71) Applicants: Shunya Kato, Seto (JP); Akihiro Kimura, Toyota (JP); Yuma Mori, Nakata-gun (JP); Hideki Furuta, Anjo (JP)

(72) Inventors: Shunya Kato, Seto (JP); Akihiro Kimura, Toyota (JP); Yuma Mori, Nakata-gun (JP); Hideki Furuta, Anjo (JP)

(73) Assignees: TOYOTA JIDOSHA KABUSHIKI KAISHA, Toyota-Shi (JP); AISIN AW CO., LTD., Anjo-Shi (JP)

( * ) Notice: Subject to any disclaimer, the term of this patent is extended or adjusted under 35 U.S.C. 154(b) by 535 days.

(21) Appl. No.: 14/136,059

(22) Filed: Dec. 20, 2013

(65) Prior Publication Data

US 2014/0180558 A1 Jun. 26, 2014

(30) Foreign Application Priority Data

Dec. 25, 2012 (JP) ..... 2012-280916

(51) Int. Cl.
*F02D 29/02* (2006.01)
*F02D 41/02* (2006.01)

(52) U.S. Cl.
CPC ..... *F02D 29/02* (2013.01); *F02D 41/0205* (2013.01); *F02D 41/0215* (2013.01); *Y10S 903/905* (2013.01)

(58) Field of Classification Search
CPC ..... F02D 29/02; F02D 41/0205
See application file for complete search history.

(56) References Cited

U.S. PATENT DOCUMENTS 6,522,024 B1 * 2/2003 Takaoka ..... B60K 6/445 180/65.235

FOREIGN PATENT DOCUMENTS

| | | | |
|---|---|---|---|
| JP | 2006-321392 | A | 11/2006 |
| JP | 2008-155718 | A | 7/2008 |
| JP | 2011-219025 | A | 11/2011 |
| JP | 2012-240441 | A | 12/2012 |
| JP | 2012-240662 | A | 12/2012 |

* cited by examiner

*Primary Examiner* — Derek D Knight
(74) *Attorney, Agent, or Firm* — Andrews Kurth Kenyon LLP

(57) ABSTRACT

A vehicle includes an internal combustion engine that generates power for rotating drive wheels, a differential mechanism that is provided between the engine and the drive wheels, and has at least three rotary elements including a first rotary element coupled to the engine, and a second rotary element coupled to the drive wheels, and a controller configured to control the engine. The controller is configured to determine whether to perform correction to increase the power generated by the engine, or perform correction to reduce the power, depending on a rotational speed of the second rotary element, when it changes a rotational speed of the engine.

7 Claims, 10 Drawing Sheets

ωm < L : POSITIVE CORRELATION REGION
ωm > L : NEGATIVE CORRELATION REGION

VEHICLE AND CONTROL METHOD FOR THE VEHICLE

INCORPORATION BY REFERENCE

The disclosure of Japanese Patent Application No. 2012-280916 filed on Dec. 25, 2012 including the specification, drawings and abstract is incorporated herein by reference in its entirety.

BACKGROUND OF THE INVENTION

1. Field of the Invention

The invention relates to a vehicle including a differential mechanism (such as a planetary gear mechanism) having at least three rotary elements between an internal combustion engine and drive wheels, and also relates to a control method for the vehicle.

2. Description of Related Art

In Japanese Patent Application Publication No. 2011-219025 (JP 2011-219025 A), a vehicle including a planetary gear mechanism (differential mechanism) between an engine and drive wheels is disclosed. The planetary gear mechanism includes a sun gear coupled, to a generator, a ring gear coupled to the drive wheels, a pinion gear that meshes with the sun gear and the ring gear, and a carrier coupled to the engine. In JP 2011-219025 A, a technology of preventing excessive rotation of the generator by restricting engine torque without departing from an acceleration request, when the acceleration request is made by the driver, in the vehicle as described above, is disclosed.

However, in the vehicle disclosed in JP 2011-219025 A, if power generated by the engine is controlled so as to prevent excessive rotation of the generator, without taking account of changes in rotational energy of the planetary gear mechanism, the excessive rotation may be promoted.

Namely, in a regular engine vehicle in which no planetary gear mechanism is provided between an engine and a transmission, a positive correlation constantly exists between power generated by the engine and the rotational speed of the engine. Namely, one of the engine power and the engine speed increases if the other increases, and one of the engine power and the engine speed decreases if the other decreases. Accordingly, it is possible to prevent excessive rotation by performing correction to reduce the power generated by the engine.

However, in a vehicle in which a planetary gear mechanism is provided between an engine and a transmission, like the vehicle disclosed in JP 2011-219025 A, the relationship between the power generated by the engine and the rotational speed of an input shaft of the transmission changes depending on conditions of the planetary gear mechanism, which may result in a negative correlation between the engine power and the input shaft speed of the transmission. Namely, one of the engine power and the input shaft speed increases if the other decreases, and one of the engine power and the input shaft speed decreases if the other increases. Therefore, in the vehicle disclosed in JP 2011-219025 A, if the correction is performed in the same manner as in the regular engine vehicle, the excessive rotation may be promoted depending on the conditions of the planetary gear mechanism.

SUMMARY OF THE INVENTION

The invention provides a vehicle including a differential mechanism having at least three rotary elements, between an internal combustion engine and drive wheels, wherein stall and excessive rotation of the internal combustion engine are appropriately suppressed, and also provides a control method for the vehicle.

A vehicle according to a first aspect of the invention includes an internal combustion engine configured to generate power for rotating drive wheels, a differential mechanism provided between the internal combustion engine and the drive wheels, and the differential mechanism having at least three rotary elements including a first rotary element coupled to the internal combustion engine and a second rotary element coupled to the drive wheels, and a controller configured to control the internal combustion engine. The controller is configured to determine whether to perform correction to increase the power generated by the internal combustion engine or perform correction to reduce the power generated by the internal combustion engine, depending on a rotational speed of the second rotary element, when the controller changes a rotational speed of the internal combustion engine.

In the vehicle according to the first aspect of the invention, there may be a positive correlation between a rotational speed of the first rotary element and rotational energy of the differential mechanism, in a first region in which the rotational speed of the second rotary element is lower than a boundary value determined according to the rotational speed of the first rotary element, and there may be a negative correlation between the rotational speed of the first rotary element and rotational energy of the differential mechanism, in a second region in which the rotational speed of the second rotary element is higher than the boundary value. The controller may increase the rotational speed of the internal combustion engine by performing correction to increase the power generated when the rotational speed of the second rotary element is included in the first region, and the controller may increase the rotational speed of the internal combustion engine by performing correction to reduce the power generated when the rotational speed of the second rotary element is included in the second region. The controller may reduce the rotational speed of the internal combustion engine by performing correction to reduce the power generated when the rotational speed of the second rotary element is included in the first region, and the controller may reduce the rotational speed of the internal combustion engine by performing correction to increase the power generated when the rotational speed of the second rotary element is included in the second region.

In the vehicle as described above, the controller may increase the rotational speed of the internal combustion engine by increasing a correction amount of increase of the power generated as the rotational speed of the second rotary element is lower when the rotational speed of the second rotary element is included in the first region, and the controller may increase the rotational speed of the internal combustion engine by setting a correction amount of reduction of the power generated to zero or by increasing the correction amount of reduction of the power as the rotational speed of the second rotary element is higher when the rotational speed of the second rotary element is included in the second region.

In the vehicle as described above, the controller may reduce the rotational speed of the internal combustion engine by increasing a correction amount of reduction of the power generated as the rotational speed of the second rotary element is lower when the rotational speed of the second rotary element is included in the first region, and the controller may reduce the rotational speed of the internal combustion engine by setting a correction amount of increase of the power generated to zero or by increasing the correction amount of increase of the power as the rotational speed of the second rotary element is higher when the rotational speed of the second rotary element is included in the second region.

The vehicle may further includes an engagement device provided between the internal combustion engine and the drive wheels, and the engagement device being configured to be placed in a selected one of an engaging state, a slipping state, and a released state. When the engaging device is in the slipping state or the released state and when the controller changes the rotational speed of the internal combustion engine, the controller may determine whether to perform correction to increase the power generated by the internal combustion engine or perform correction to reduce the power generated by the internal combustion engine, depending on the rotational speed of the second rotary element.

The engaging device may be a transmission configured to change a speed ratio. The vehicle may further include a first rotary electric machine, and a second rotary electric machine. The differential mechanism may be a planetary gear mechanism including a sun gear coupled to the first rotary electric machine, a ring gear coupled to the second rotary electric machine, a pinion gear that meshes with the sun gear and the ring gear, and a carrier that holds the pinion gear such that the pinion gear rotates about itself and rotates about an axis of the planetary gear mechanism. The first rotary element may be the carrier, and the second rotary element may be the ring gear.

According to the first aspect of the invention, in the vehicle including the differential mechanism having at least three rotary elements between the internal combustion engine and the drive wheels, stall and excessive rotation of the internal combustion engine can be appropriately suppressed.

A second aspect of the invention provides a control method for a vehicle including an internal combustion engine configured to generate power for rotating drive wheels, and a differential mechanism provided between the internal combustion engine and the drive wheels, and the differential mechanism having at least three rotary elements including a first rotary element coupled to the internal combustion engine, and a second rotary element coupled to the drive wheels. The control method includes the steps of controlling the internal combustion engine, and determining whether to perform correction to increase the power generated by the internal combustion engine or perform correction to reduce the power generated by the internal combustion engine, depending on a rotational speed of the second rotary element, when changing a rotational speed of the internal combustion engine.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
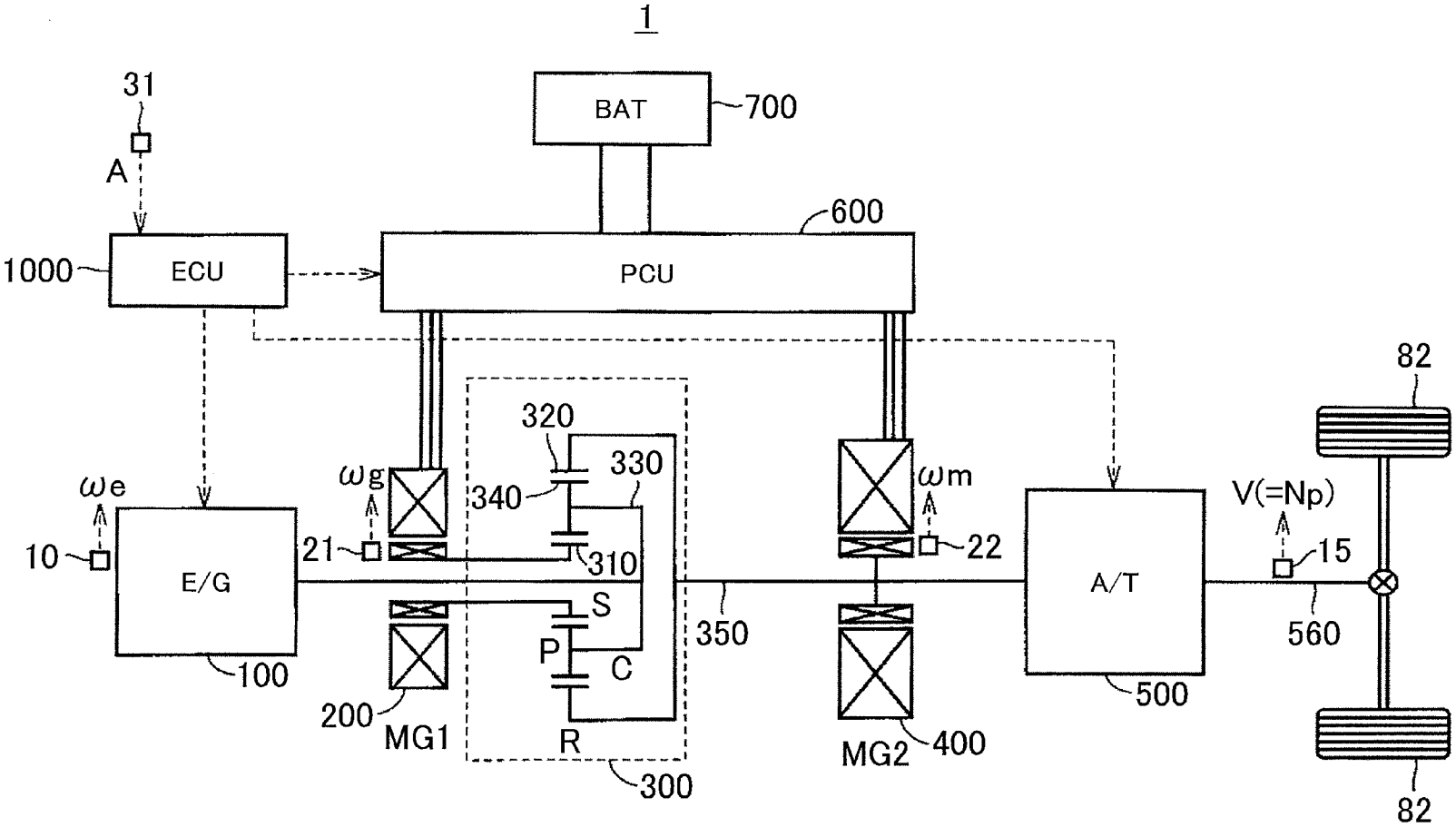
FIG. 1 is an overall block diagram of a vehicle.

Some embodiments of the invention will be described with reference to the drawings. In the following description, the same reference numerals are assigned to the same components, which have the same names and functions. Accordingly, these components will not be repeatedly described in detail. FIG. 1 is an overall block diagram of a vehicle 1 according to a first embodiment of the invention. The vehicle 1 runs while rotating drive wheels 82. The vehicle 1 includes an engine (E/G) 100, first motor-generator (which will be called "first MG") 200, power split device 300, second motor-generator (which will be called "second MG") 400, automatic transmission (A/T) 500, power control unit (which will be called "PCU") 600, battery 700, and an electronic control unit (which will be called "ECU") 1000.

The engine 100 generates power (drive power Pv) for rotating the drive wheels 82. The power generated by the engine 100 is received by the power split device 300.

The power split device 300 divides the power received from the engine 100, into power to be transmitted to the drive wheels 82 via the automatic transmission 500, and power to be transmitted to the first MG 200.

The power split device 300 is a planetary gear mechanism (differential mechanism) including a sun gear (S) 310, ring gear (R) 320, carrier (C) 330, and a pinion gear (P) 340. The sun gear (S) 310 is coupled to a rotor of the first MG 200. The ring gear (R) 320 is coupled to the drive wheels 82 via the automatic transmission 500. The pinion gear (P) 340 meshes with the sun gear (S) 310 and the ring gear (R) 320. The carrier (C) 330 holds the pinion gear (P) 340 such that the pinion gear (P) 340 can, rotate about itself and also rotate about the axis of the power split device 300. The carrier (C) 330 is coupled to a crankshaft of the engine 100.

Each of the first MG 200 and the second MG 400 is an AC rotary electric machine, and functions as a motor and a generator. In this embodiment, the second MG 400 is provided between the power split device 300 and the automatic transmission 500. More specifically, a rotor of the second MG 400 is connected to a rotary shaft 350 that couples the ring gear (R) 320 of the power split device 300 with an input shaft of the automatic transmission 500.

The automatic transmission 500 is provided between the rotary shaft 350 and a drive shaft 560. The automatic transmission 500 has a gear unit including a plurality of hydraulic friction devices (such as clutches and brakes), and a hydraulic circuit that supplies a hydraulic pressure responsive to a control signal from the ECU 1000, to each of the friction devices. By changing engaging conditions of the plurality of friction devices, the automatic transmission 500 is switched to any one of an engaged state, a slipping state, and a released state. In the engaged state, the entire rotational power of the input shaft of the automatic transmission 500 is transmitted to the output shaft of the automatic transmission 500. In the slipping state, a part of the rotational power of the input shaft of the automatic transmission 500 is transmitted to the output shaft of the automatic transmission 500. In the released state, power transmission between the input shaft and output shaft of the automatic transmission 500 is cut off. The automatic transmission 500 is formed such that the speed ratio (the ratio of the input shaft rotational speed to the output shaft rotational speed) of the transmission 500 in the engaged state can be switched to a selected one of predetermined two or more speeds (speed ratios). While the automatic transmission 500 is normally placed in the engaged state, it is temporarily brought into the slipping state or released state during shifting (during upshifting or downshifting), and is returned to the engaged state after completion of shifting.

The PCU 600 converts DC (direct-current) power supplied from the battery 700 into AC (alternating-current) power, and delivers the AC power to the first MG 200 and/or the second MG 400. As a result, the first MG 200 and/or the second MG 400 are driven. Also, the PCU 600 converts AC power generated by the first MG 200 and/or the second MG 400, into DC power; and delivers the DC power to the battery 700, so that the battery 700 is charged.

The battery 700 stores high-voltage (e.g., about 200V) DC power for driving the first MG 200 and/or the second MG 400. The battery 700 typically includes nickel hydride or lithium ions. It is, however, possible to employ a capacitor having a large capacity, in place of the battery 700.

The vehicle 1 further includes an engine speed sensor 10, vehicle speed sensor 15, resolvers 21, 22, and an accelerator pedal position sensor 31. The engine speed sensor 10 detects the rotational speed of the engine 100 (which will be called "engine speed ωe"). The vehicle speed sensor 15 detects the rotational speed of the drive shaft 560 as the vehicle speed V. The resolver 21 detects the rotational speed of the first MG 200 (which will be called "first MG speed cog"). The resolver 22 detects the rotational speed of the second MG 400 (which will be called "second MG speed ωm"). The accelerator pedal position sensor 31 detects the amount by which the accelerator pedal is operated by the user (which will be called "accelerator operation amount A").

The ECU 1000 incorporates a central processing unit (CPU) and a memory (both of which are not shown). The CPU performs prescribed arithmetic processing, based on information stored in the memory and information received from the respective sensors. The ECU 1000 controls various devices installed on the vehicle 1, based on the results of arithmetic processing.

The ECU 1000 determines required drive power Pvreq from the accelerator operation amount A and the vehicle speed V. The ECU 1000 calculates engine target power, first MG target power, and second MG target power, according to given algorithms, so as to satisfy the required drive power Pvreq. The ECU 1000 controls the engine 100 (specifically, the ignition timing, throttle opening, fuel injection amount, etc.) so that the actual engine power becomes equal to the engine target power. Also, the ECU 1000 controls the PCU 600, thereby to control electric current that flows through the first MG 200 so that the actual power of the first MG 200 becomes equal to the first MG target power. Similarly, the ECU 1000 controls the PCU 600, thereby to control electric current that flows through the second MG 400 so that the actual power of the second MG 400 becomes equal to the second MG target power.

The ECU 1000 determines a target speed (or speed ratio of the automatic transmission 500) corresponding to the accelerator operation amount A and the vehicle speed V, referring to a predetermined shift map, and controls the automatic transmission 500 so that the actual speed becomes equal to the target speed.

Figure 2:
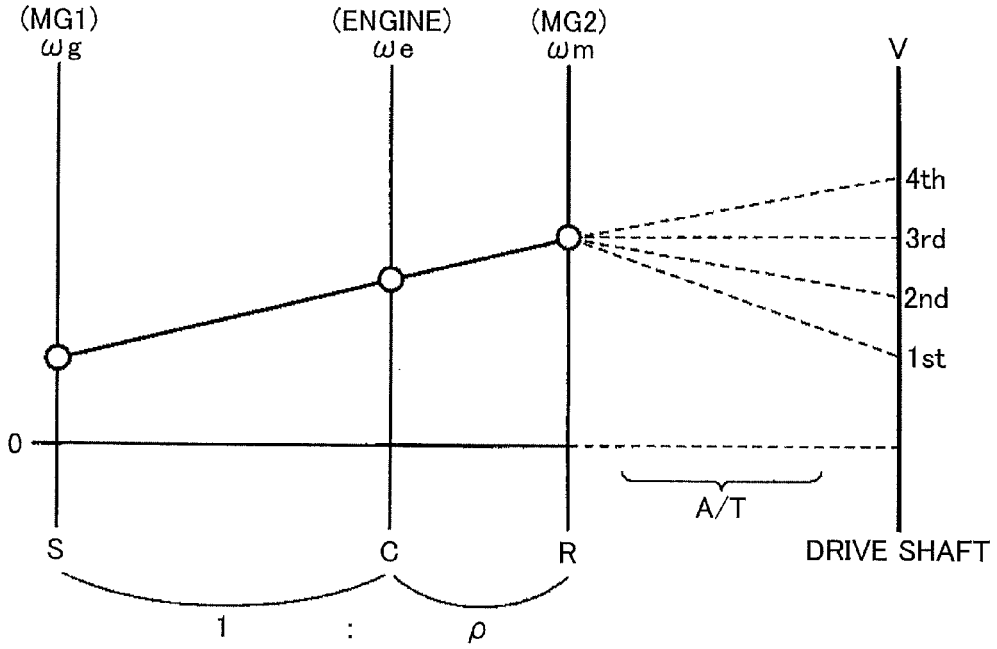
FIG. 2 is a nomographic chart of a power split device.

FIG. 2 shows a nomographic chart of the power split device 300. As shown in FIG. 2, the rotational speed of the sun gear (S) 310 (i.e., the first MG speed cog), the rotational speed of the carrier (C) 330 (i.e., the engine speed ωe), and the rotational speed of the ring gear (R) 320 (i.e., the second MG speed corn) are related to one another so as to be connected by a straight line on the nomographic chart of the power split, device 300 (namely, the three rotational speeds are related to one another such that, if two of the rotational speeds are determined, the remaining rotational speed is determined). In this embodiment, the automatic transmission (A/T) 500 is provided between the ring gear (R) 320 and the drive shaft 560. Therefore, the ratio between the second MG speed ωm and the vehicle speed V is determined by the speed (speed ratio) established in the automatic transmission 500. FIG. 2 illustrates the case where the automatic transmission 500 can establish any forward-drive speed selected from the first speed to the fourth speed.

When the engine speed ωe is included in a stall region (a low-speed region that is lower than a control lower-limit value ω0), the ECU 1000 generates a command (which will be called "stall suppression command") to increase the engine speed ωe so as to suppress stall of the engine 100, to the engine 100.

Also, when the engine speed ωe is included in an excessive rotation region (a high-speed region that exceeds a control upper-limit value ω1), the ECU 1000 generates a command (which will be called "excessive rotation suppression command") to reduce the engine speed ωe so as to suppress excessive rotation of the engine 100 or power split device 300, to the engine 100.

Figure 3:
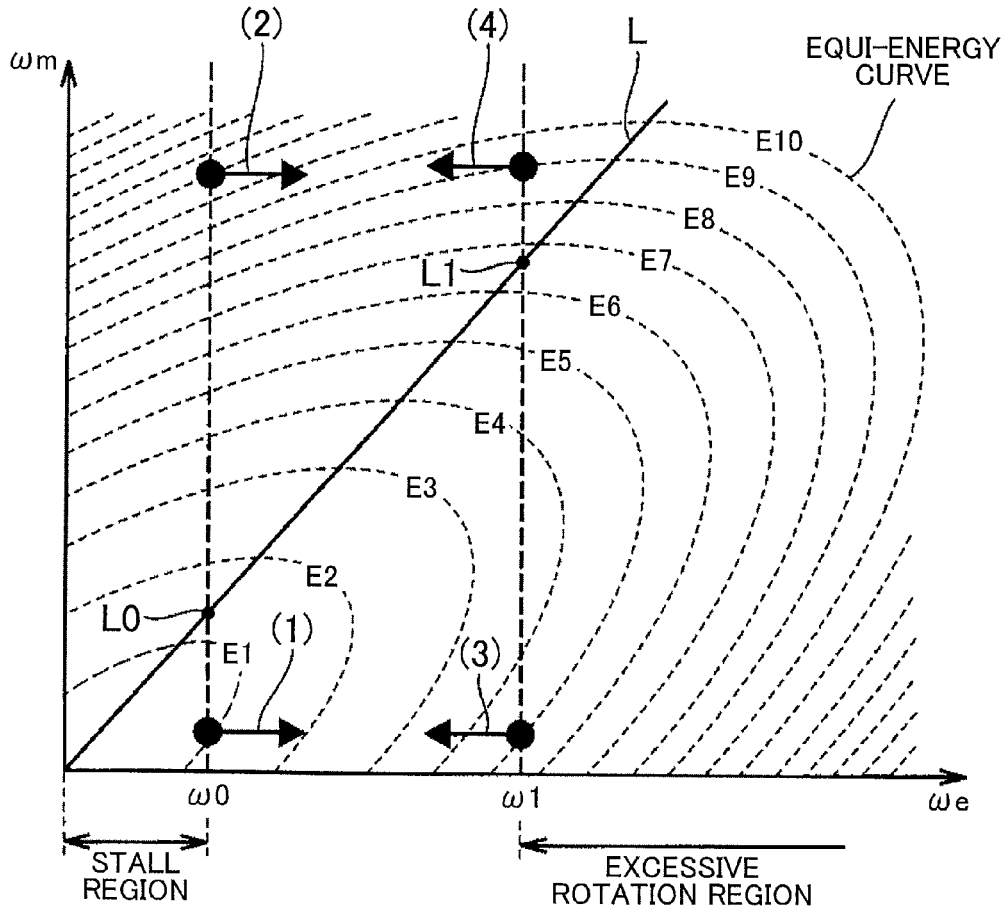
FIG. 3 is a view schematically showing the distribution of the overall rotational energy of the power split device, and how the engine speed changes in response to a stall suppression command and an excessive rotation suppression command.

FIG. 3 is a view schematically showing the distribution of the overall rotational energy of the power split device 300, and how the engine speed changes when the stall suppression command is issued and when the excessive rotation suppression command is issued. In FIG. 3, the horizontal axis indicates the engine speed ωe (the rotational speed of the carrier (C) 330), and the vertical axis indicates the second MG speed ωm (the rotational speed of the ring gear (R) 320). As explained above with reference to FIG. 2, if the engine speed ωe and the second MG speed win are determined, the remaining first MG speed ωg (the rotational speed of the sun gear (S) 310) is determined, and the rotational speeds of all rotary elements in the power split device 300 can be specified. Therefore, the overall rotational energy (which will be simply called "total energy Esum") of the power split device 300 will be determined, using the engine speed ωe and the second MG speed cam as parameters. In FIG. 3, the total energy Esum is indicated by using a set of equi-energy curves (each of which is a curve connecting points of equal energy, for each given energy). Values E1, E2, E3, . . . E10, . . . of the total energy Esum indicated by the respective equi-energy curves are higher as the distance from the origin of the graph of FIG. 3 is larger. Namely, these values have a relationship of E1<E2<E3 <E4 . . . <E10 . . . .

In a regular engine vehicle, no device corresponding to the power split device 300 is provided between the engine and the automatic transmission. Therefore, a positive correlation constantly exists between the power generated by the engine and the engine speed. Namely, one of the engine power and the engine speed increases as the other increases, and one of the engine power and the engine speed decreases as the other decreases. Accordingly, when the engine speed is in the stall region, the engine power is corrected to be increased so as to increase the engine speed and thus suppress engine stall. Also, when the engine speed is in the excessive rotation region, the engine power is corrected to be reduced so as to reduce the engine speed and thus suppress excessive rotation.

In the vehicle 1 of this embodiment, however, the power split device 300 is provided between the engine 100 and the automatic transmission 500. In the vehicle 1 as described above, if the engine power is corrected in the same manner as in the regular engine vehicle, the engine speed ωe may not be changed to the target engine speed, depending on conditions of the power split device 300.

Namely, as is understood from FIG. 3, when the second MG speed corn does not change, the relationship between the engine speed ωe and the total energy Esum in a region on the upper side of a boundary line L is opposite to that in a region on the lower side of the boundary line L. More specifically, in the region on the lower side of the boundary line L, there is a positive correlation (one of two parameters increases as the other increases, and the one parameter decreases as the other decreases) between the engine speed ωe and the total energy Esum. Therefore, the region on the lower side of the boundary line L will be called "positive correlation region". On the other hand, in the region on the upper side of the boundary line L, there is a negative correlation (one of two parameters decreases as the other increases, and the one parameter increases as the other decreases) between the engine speed ωe and the total energy Esum. Therefore, the region on the upper side of the boundary line L will be called "negative correlation region".

The boundary line L may be expressed by the following equation (a).

$$\omega m=\omega e\{(1+\rho)^2 Ig+\rho^2 Ie\}/\{(1+\rho)Ig\} \quad (a)$$

In the above equation (a), "Ig" is the moment of inertia of the first MG 200, and "Ie" is the moment of inertia of the engine 100, while "ρ" is the planetary gear ratio of the power split device 300.

In the following description, the value of the boundary line L when the engine speed ωe is equal to the control lower-limit value ω0 may be called "lower-limit boundary value L0", and the value of the boundary line L when the engine speed ωe is equal to the control upper-limit value ω1 may be called "upper-limit boundary value L1", as indicated in FIG. 3.

In FIG. 3, changes in the engine speed in response to the stall suppression command are represented by patterns (1), (2), and changes in the engine speed in response to the excessive rotation suppression command are represented by patterns (3), (4). In FIG. 3, it is assumed that the second MG speed ωm does not change in response to the stall suppression command and the excessive rotation suppression command.

In the pattern (1) where the stall suppression command is executed in the positive correlation region, the engine speed ωe increases, and the total energy Esum also increases with the increase of the engine speed ωe. In other words, when the stall suppression command is executed in the positive correlation region, the total energy Esum needs to be increased. On the other hand, in the pattern (2) where the stall suppression command is executed in the negative correlation region, the engine speed ωe increases, but the total energy Esum decreases. In other words, when the stall suppression command is executed in the negative correlation region, the total energy Esum needs to be reduced.

In the pattern (3) where the excessive rotation suppression command is executed in the positive correlation region, the engine speed ωe decreases, and the total energy Esum also decreases with the reduction of the engine speed ωe. In other words, when the excessive rotation suppression command is executed in the positive correlation region, the total energy Esum needs to be reduced. On the other hand, in the pattern (4) where the excessive rotation suppression command is executed in the negative correlation region, the engine speed ωe decreases, but the total energy Esum increases. In other words, when the excessive rotation suppression command is executed in the negative correlation region, the total energy Esum needs to be increased.

In view of the above-described characteristics, when the engine speed ωe needs to be changed, the ECU 1000 of this embodiment determines whether the power generated by the engine 100 (which will be called "engine power Pe") is corrected to be increased, or corrected to be reduced, depending on the second MG speed ωm. Typical examples of "the case where the engine speed ωe needs to be changed" include the case where the above-mentioned stall suppression command is issued and the case where the above-mentioned excessive rotation suppression command is issued. Another example is the case where sequential shift is requested. The sequential shift is requested when the user performs a shifting operation, in a vehicle having an operating mode in which the engine speed is changed through the user's shifting operation (using paddles, etc.).

In the following, a method of correcting the engine power Pe when the stall suppression command or excessive rotation suppression command is issued will be described in detail, while being illustrated by an example.

TABLE 1 indicates the method of correcting the engine power Pe, which method is performed by the ECU 1000.

TABLE 1

| Object to be suppressed | Pattern | Region in which ωm is included | Pe correction |
|---|---|---|---|
| Engine stall | (1) | positive correlation region | increase |
| | (2) | negative correlation region | reduction |
| Excessive rotation | (3) | positive correlation region | reduction |
| | (4) | negative correlation region | increase |

In the case of pattern (1) where the second MG speed ωm is included in the positive correlation region (region lower than the boundary line L) when the stall suppression command is issued, the ECU 1000 performs correction to increase the engine power Pe.

In the case of pattern (2) where the second MG speed ωm is included in the negative correlation region (region higher than the boundary line L) when the stall suppression command is issued, the ECU 1000 performs correction to reduce the engine power Pe.

In the case of pattern (3) where the second MG speed ωm is included in the positive correlation region (region lower than the boundary line L) when the excessive rotation suppression command is issued, the ECU 1000 performs correction to reduce the engine power Pe.

In the case of pattern (4) where the second MG speed ωm is included in the negative correlation region (region higher than the boundary line L) when the excessive rotation suppression command is issued, the ECU 1000 performs correction to increase the engine power Pe.

Thus, when the ECU 1000 changes the engine speed ωe, it determines whether to increase or reduce the engine power Pe, depending on whether the second MG speed ωm is included in the positive correlation region or included in the negative correlation region. The manner of correcting the engine power Pe in the cases of patterns (2), (4) is opposite to the manner of correcting in the regular engine vehicle.

Figure 4:
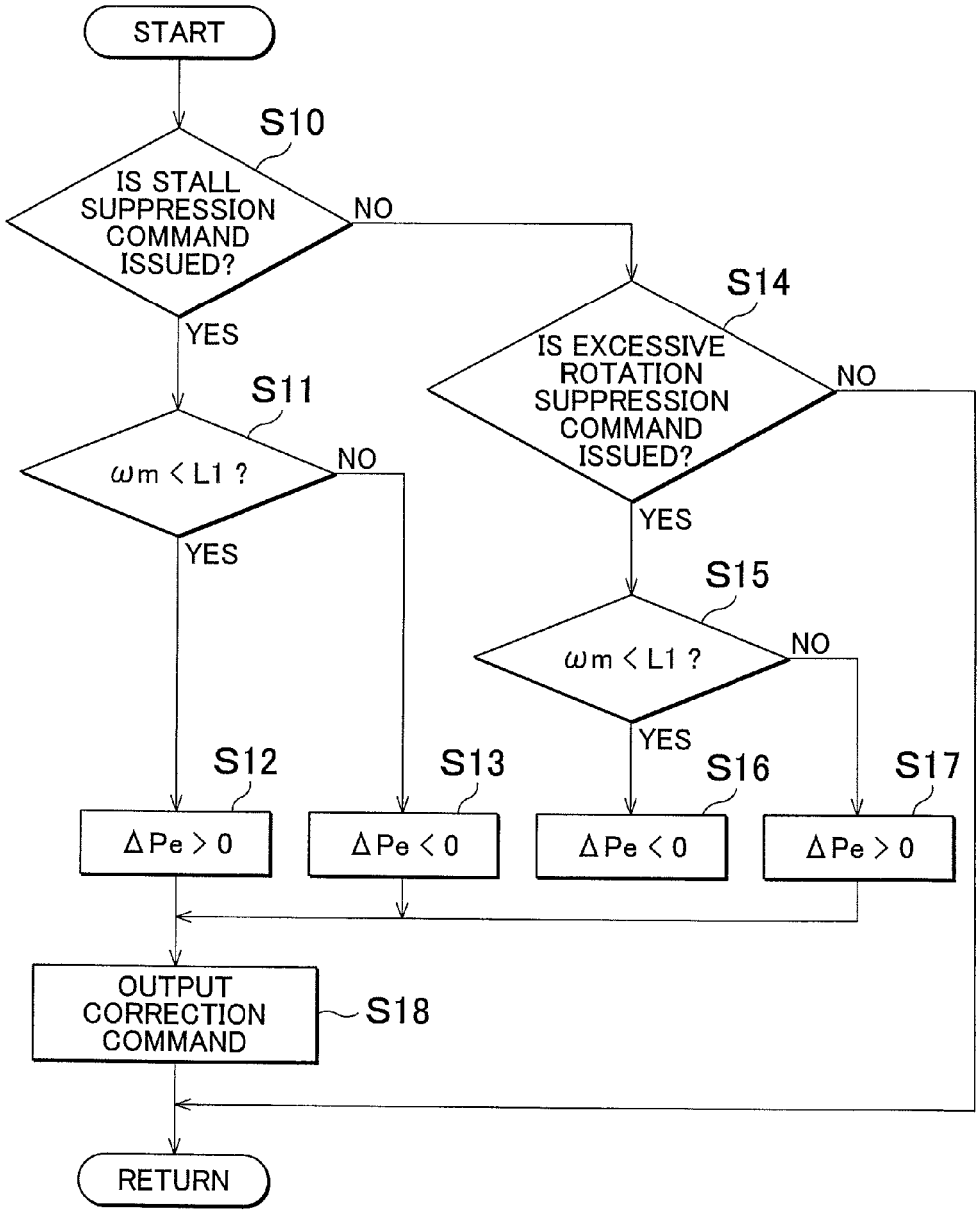
FIG. 4 is a flowchart illustrating one example of control routine executed by ECU according to a first embodiment of the invention.

FIG. 4 is a flowchart illustrating one example of control routine executed by the ECU 1000 when it corrects the engine power Pe.

In step S10, the ECU 1000 determines whether a stall suppression command is issued. If the stall suppression command is issued (YES in step S10), the ECU 1000 determines in step S11 whether the second MG speed ωm is lower than the boundary line L (or included in the positive correlation region). At this time, the ECU 1000 may calculate the boundary line L corresponding to the current engine speed ωe, using the above-indicated equation (a). Also, calculation results of the above-indicated equation (a) may be stored in advance in the form of a map, and the ECU 1000 may determine a value of the boundary line L corresponding to the current engine speed ωe, referring to the map. Also, the ECU 1000 may store a value (ωm) of the lower-limit boundary value L0 in advance, and may determine whether the second MG speed ωm is lower than the lower-limit boundary value L0.

If the second MG speed ωm is lower than the boundary line L (YES in step S11), namely, in the case of pattern (1) indicated in FIG. 3 and TABLE 1 as described above, the ECU 1000 sets an engine power correction amount ΔPe to a given positive value in step S12, and performs correction to increase the engine power Pe.

If the second MG speed ωm is higher than the boundary line L (NO in step S11), namely, in the case of pattern (2) indicated in FIG. 3 and TABLE 1 as described above, the ECU 1000 sets the engine power correction amount ΔPe to a given negative value in step S13, and performs correction to reduce the engine power Pe.

If no stall suppression command is issued (NO in step S10), on the other hand, the ECU 1000 determines in step S14 whether an excessive rotation suppression command is issued.

If the excessive rotation suppression command is issued (YES in step S14), the ECU 1000 determines in step S15 whether the second MG speed ωm is lower than the boundary line L (or included in the positive correlation region). At this time, the ECU 1000 may determine a value of the boundary line L corresponding to the current engine speed ωe, using the above-indicated equation (a), or referring to a map of pre-stored calculation results of the above equation (a), in the same manner as in step S11. Also, the ECU 1000 may determine whether the second MG speed corn is lower than the upper-limit boundary value L1.

If the second MG speed corn is lower than the boundary line L (YES in step S15), namely, in the case of pattern (3) indicated in FIG. 3 and TABLE 1 as described above, the ECU 1000 sets the engine power correction amount ΔPe to a given negative value in step S16, and performs correction to reduce the engine power Pe.

If the second MG speed corn is higher than the boundary line L (NO in step S15), namely, in the case of pattern (4) indicated in FIG. 3 and TABLE 1 as described above, the ECU 1000 sets the engine power correction amount ΔPe to a given positive value in step S17, and performs correction to increase the engine power Pe.

In step S18, the ECU 1000 generates command signals (such as a throttle control signal, and an ignition timing signal) for effecting the correction with the correction amount set in step S12, S13, S16 or S17, to the engine 100.

Figure 5:
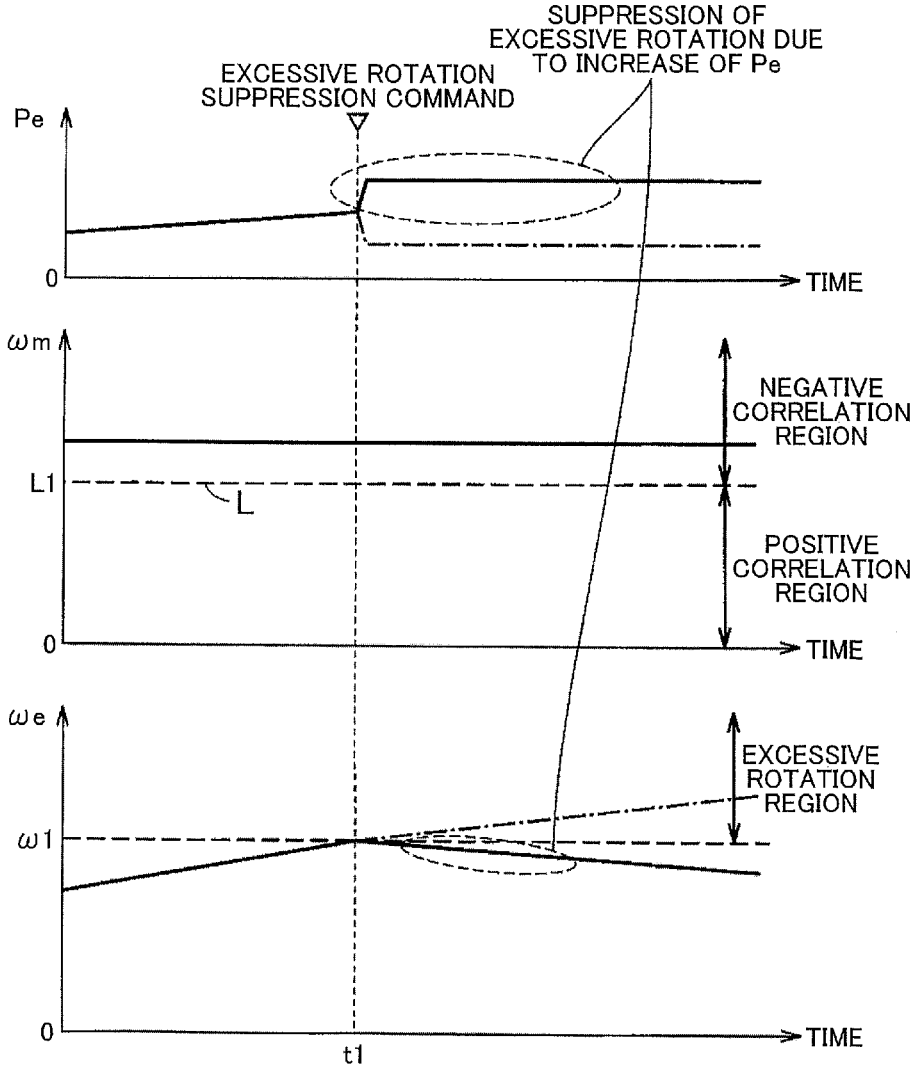
FIG. 5 is a view showing changes in engine power Pe and engine speed ωe.

FIG. 5 shows changes in the engine power Pe and the engine speed ωe in the case (the case of pattern (4) in FIG. 3 and TABLE 1) where the second MG speed ωm is included in the negative correlation region (region higher than the boundary line L) when an excessive rotation suppression command is issued.

At time t1 when the excessive rotation suppression command is issued, the second MG speed ωm is included in the negative correlation region (ωm>L). In the negative correlation region, the total energy Esum needs to be increased so as to reduce the engine speed ωe. To this end, the ECU 1000 performs correction to increase the engine power Pe. As a result, the total energy Esum is increased, so that the engine speed ωe is reduced, and excessive rotation of the engine 100 is suppressed.

If the engine power Pe is corrected to be reduced in the negative correlation region, for example, the total energy Esum is reduced, so that the engine speed we increases as indicated by a one-dot chain line (in FIG. 5), and excessive rotation cannot be suppressed. In this embodiment, this problem can be solved.

As described above, when the engine speed ωe needs to be changed (more specifically, when the stall suppression command or excessive rotation suppression command is issued), the ECU 1000 of this embodiment determines whether to perform correction to increase the engine power Pe or perform correction to reduce the engine power Pe, depending on the second MG speed ωm. In this manner, the ECU 1000 can appropriately change the engine speed ωe, irrespective of whether the second MG speed ωm is included in the positive correlation region or negative correlation region as indicated in FIG. 3. Therefore, stall and excessive rotation of the engine 100 can be appropriately suppressed.

A modified example of the first embodiment will be described. In the vehicle 1, the automatic transmission 500 is provided between the ring gear (R) 320 and the drive wheels 82. The automatic transmission 500 is temporarily placed in a slipping state or released state during shifting. Therefore, the ring gear (R) 320 and the drive wheels 82 are not in a directly coupled state during shifting, and the moment of inertia of the ring gear (R) is relatively reduced. As a result; the proportion of the rotational energies of the sun gear (S) 310 and the carrier (C) 330 (namely, the rotational energies of the first MG 200 and the engine 100) to the total energy Esum is relatively increased.

In view of the above point, the correction routine as illustrated in the flowchart of FIG. 4 may be executed during shifting (during upshifting or downshifting) of the automatic transmission 500. Next, a second embodiment of the invention will be described. In the above-described first embodiment, it is determined whether the engine power Pe is corrected to be increased or corrected to be reduced, depending on the second MG speed ωm.

In the second embodiment, on the other hand, the amount of correction of the engine power Pe, as well as the direction (positive or negative) of correction of the engine power Pe, is changed according to the second MG speed ωm. The configuration, function, and processing of the second embodiment, other than this point, are substantially identical with those of the above-described first embodiment, and thus will not be described in detail.

Figure 6:
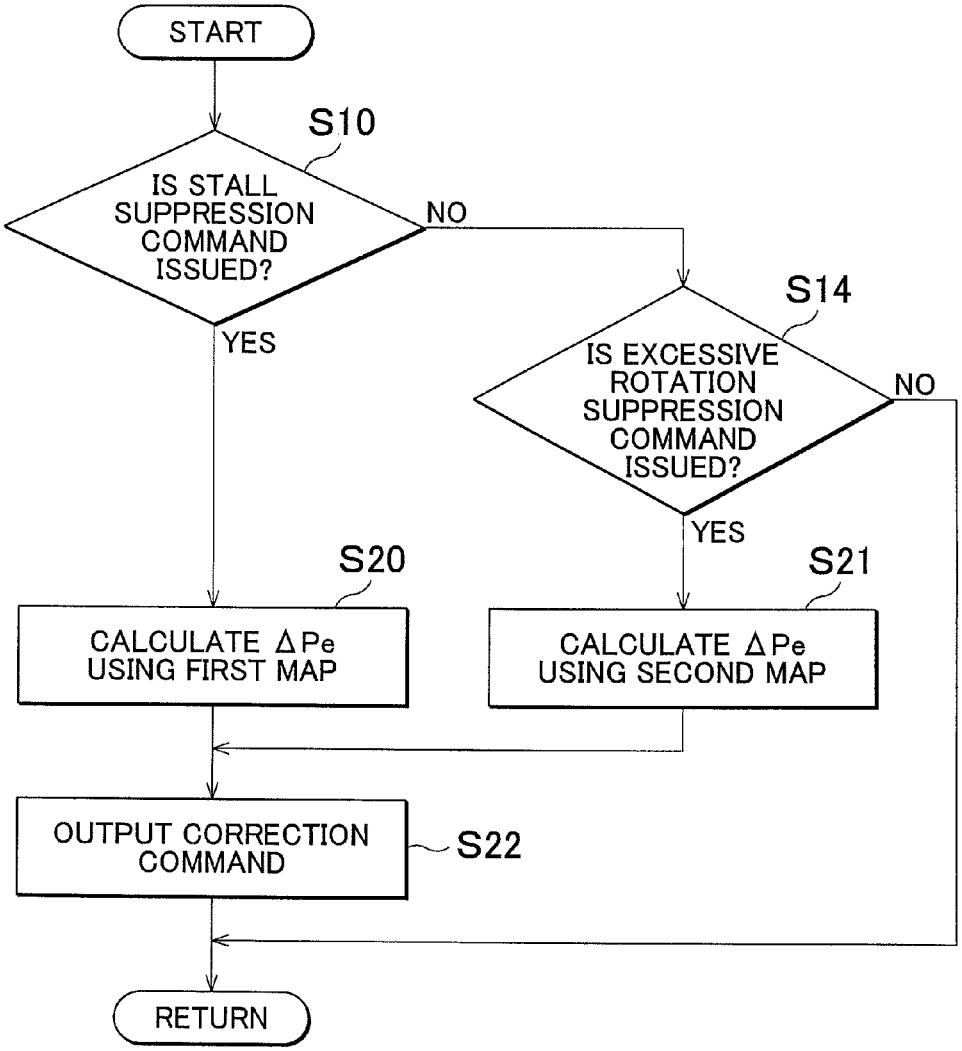
FIG. 6 is a flowchart illustrating one example of control routine executed by ECU according to a second embodiment of the invention.

FIG. 6 is a flowchart illustrating one example of control routine executed when the ECU 1000 of the second embodiment corrects the engine power Pe. Steps to which the same step numbers as those of steps shown in FIG. 4 are assigned, out of steps shown in FIG. 6, will not be repeatedly described in detail, since these steps have already been described.

Figure 7:
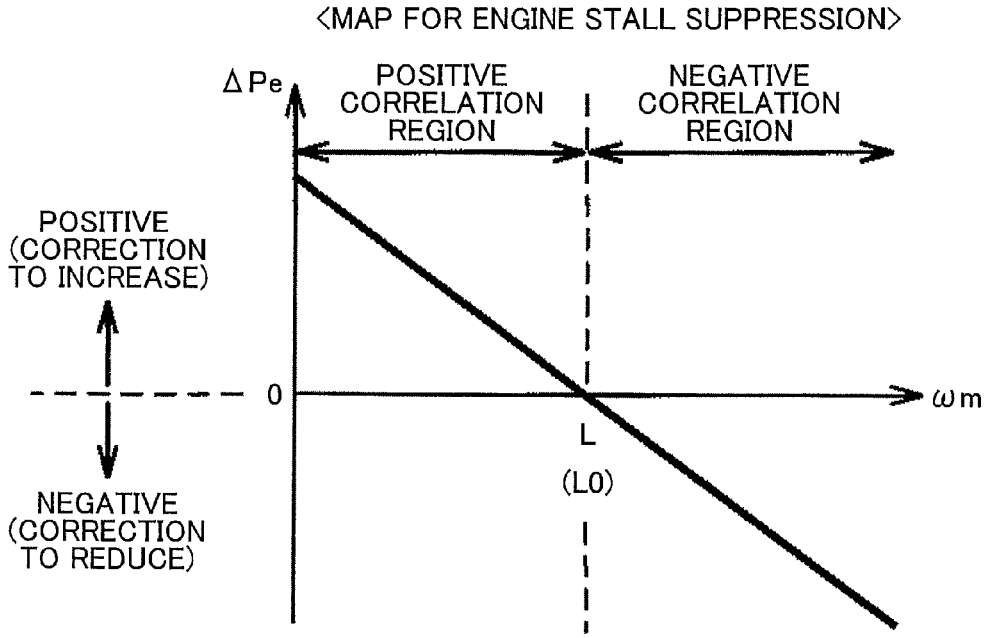
FIG. 7 is a view showing a map for engine stall suppression.

When a stall suppression command is issued (YES in step S10), the ECU 1000 calculates the engine power correction amount ΔPe corresponding to the second MG speed mm in step S20, using a map for stall suppression as shown in FIG. 7, which will be described later.

Figure 8:
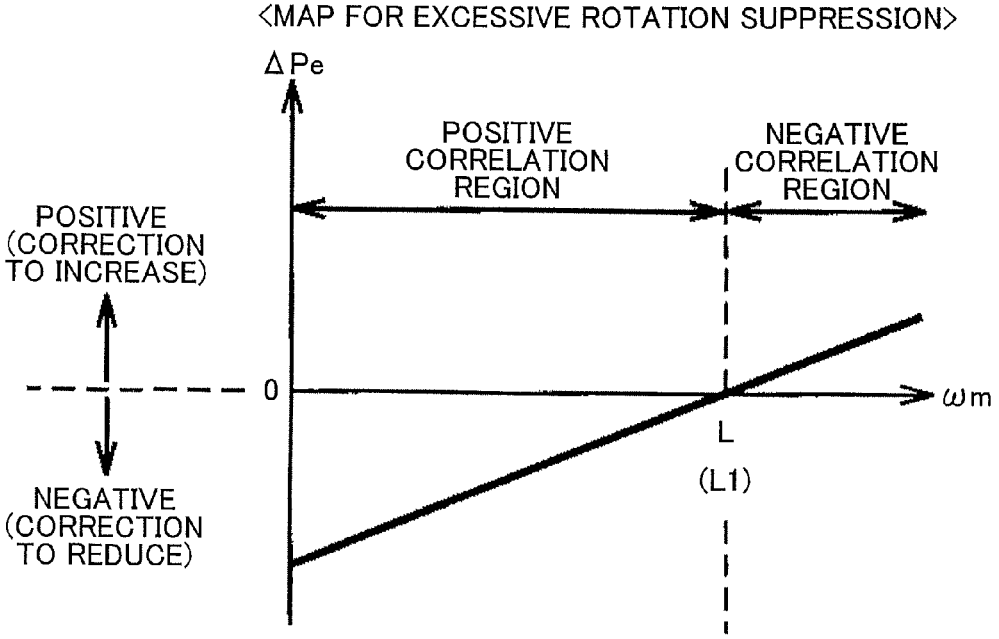
FIG. 8 is a view showing a map for excessive rotation suppression.

When an excessive rotation suppression command is issued (YES in step S14), the ECU 1000 calculates the engine power correction amount ΔPe corresponding to the second MG speed ωm in step S21, using a map for excessive rotation suppression as shown in FIG. 8, which will be described later.

In step S22, the ECU 1000 generates command signals for effecting the correction with the correction amount set in step S20 or S21, to the engine 100.

FIG. 7 shows the map for engine stall suppression, which is used in step S20 of FIG. 6. In this map, the engine power correction amount ΔPe with which engine stall can be suppressed is plotted in advance in the form of a map, using the second MG speed mm as a parameter. In the positive, correlation region in which ωm<L, the engine power correction amount ΔPe is set to a positive value (the engine power Pe is corrected to be increased), and an absolute value of the engine power correction amount ΔPe (the amount of increase of Pe) is set to a larger value as the second MG speed mm is lower (as a difference between mm and L is larger). When cm is equal to L, the engine power correction amount ΔPe is set to 0. In the negative correlation region in which ωm>L, the engine power correction amount ΔPe is set to a negative value (the engine power Pe is corrected to be reduced), and an absolute value of the engine power correction amount ΔPe (the amount of reduction of Pe) is increased as the second MG speed corn is higher (as a difference between corn and L is larger).

FIG. 8 shows a map for excessive rotation suppression, which is used in step S21 of FIG. 6. In this map, the engine power correction amount ΔPe with which excessive rotation can be suppressed is plotted in advance in the form of a map, using the second MG speed ωm as a parameter. In the positive correlation region in which ωm<L, the engine power correction amount ΔPe is set to a negative value (the engine power Pe is corrected to be reduced), and an absolute value of the engine power correction amount ΔPe (the amount of reduction of Pe) is set to a larger value as the second MG speed ωm is lower (as a difference between corn and L is larger). When ωm is equal to L, the engine power correction amount ΔPe is set to 0. In the negative correlation region in which ωm>L, the engine power correction amount ΔPe is set to a positive value (the engine power Pe is corrected to be increased), and an absolute value of the engine power correction amount ΔPe (the amount of increase of Pe) is increased as the second MG speed corn is higher (as a difference between win and L is larger).

As described above, when the engine speed ωe needs to be changed (e.g., when the stall suppression command or excessive rotation command as described above is issued), the ECU 1000 of this embodiment changes the amount of correction of the engine power Pe, as well as the direction (positive or negative) of correction of the engine power Pe, according to the second MG speed corn. Therefore, the engine speed ωe can be changed as desired at an earlier point.

A modified example of the second embodiment will be described. The map for engine stall suppression as shown in FIG. 7 and the map for excessive rotation suppression as shown in FIG. 8 are mere examples, and the maps used for these purposes are not limited to those of FIG. 7 and FIG. 8.

Figure 9:
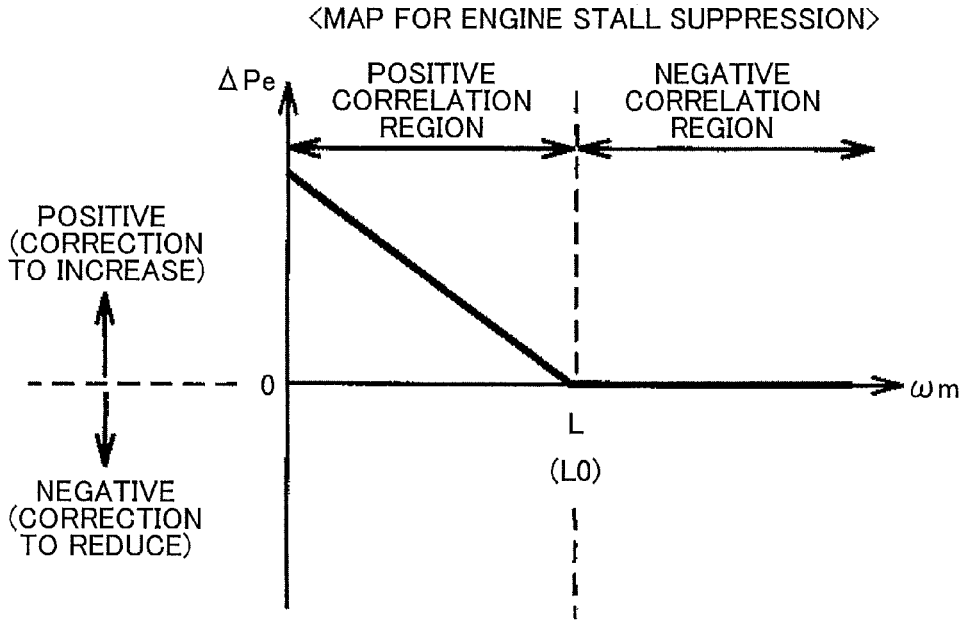
FIG. 9 is a view showing a modified example of map for engine stall suppression.

FIG. 9 shows a modified example of map for engine stall suppression. In this modified example, in the positive correlation region, the engine power correction amount ΔPe is set to a positive value (the engine power Pe is corrected to be increased), and an absolute value of the engine power correction amount ΔPe (the amount of increase of Pe) is set to a larger value as the second MG speed corn is lower (as a difference between corn and L is larger). In the negative correlation region, on the other hand, the engine power correction amount ΔPe is set to 0. Namely, the engine power Pe is not corrected in the negative correlation region.

Figure 10:
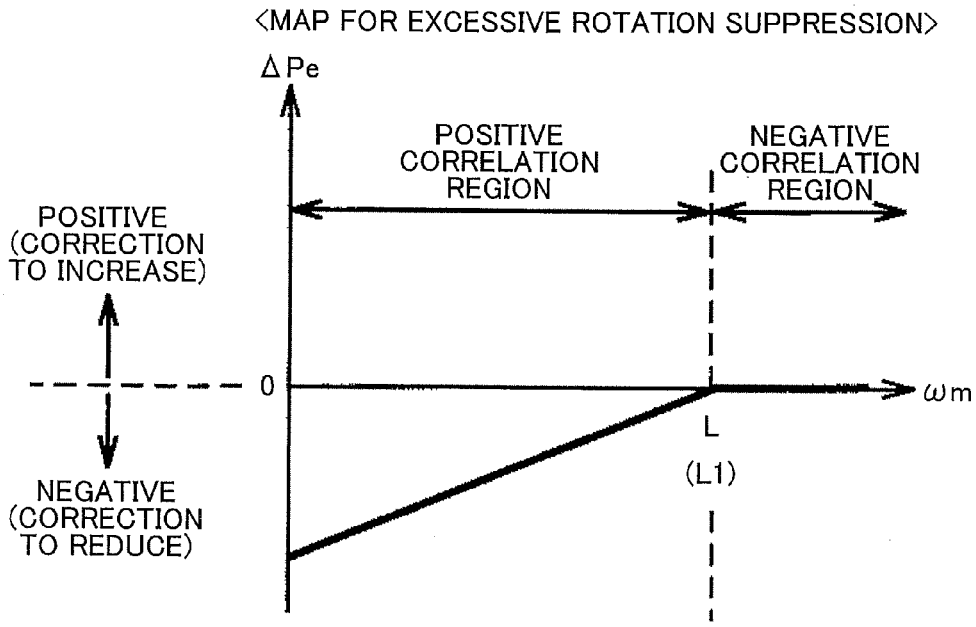
FIG. 10 is a view showing a modified example of map for excessive rotation suppression.

FIG. 10 shows a modified example of map for excessive rotation suppression. In this modified example, in the positive correlation region, the engine power correction amount ΔPe is set to a negative value (the engine power Pe is corrected to be reduced), and an absolute value of the engine power correction amount ΔPe (the amount of reduction of Pe) is set to a larger value as the second MG speed corn is lower (as a difference between corn and L is larger). In the negative correlation region, on the other hand, the engine power correction amount ΔPe is set to 0. Namely, the engine power Pe is not corrected in the negative correlation region.

A modified example of the vehicle configuration will be described. The configuration of the vehicle 1 according to the above-described first and second embodiments may be changed as described below, for example.

Figure 11:
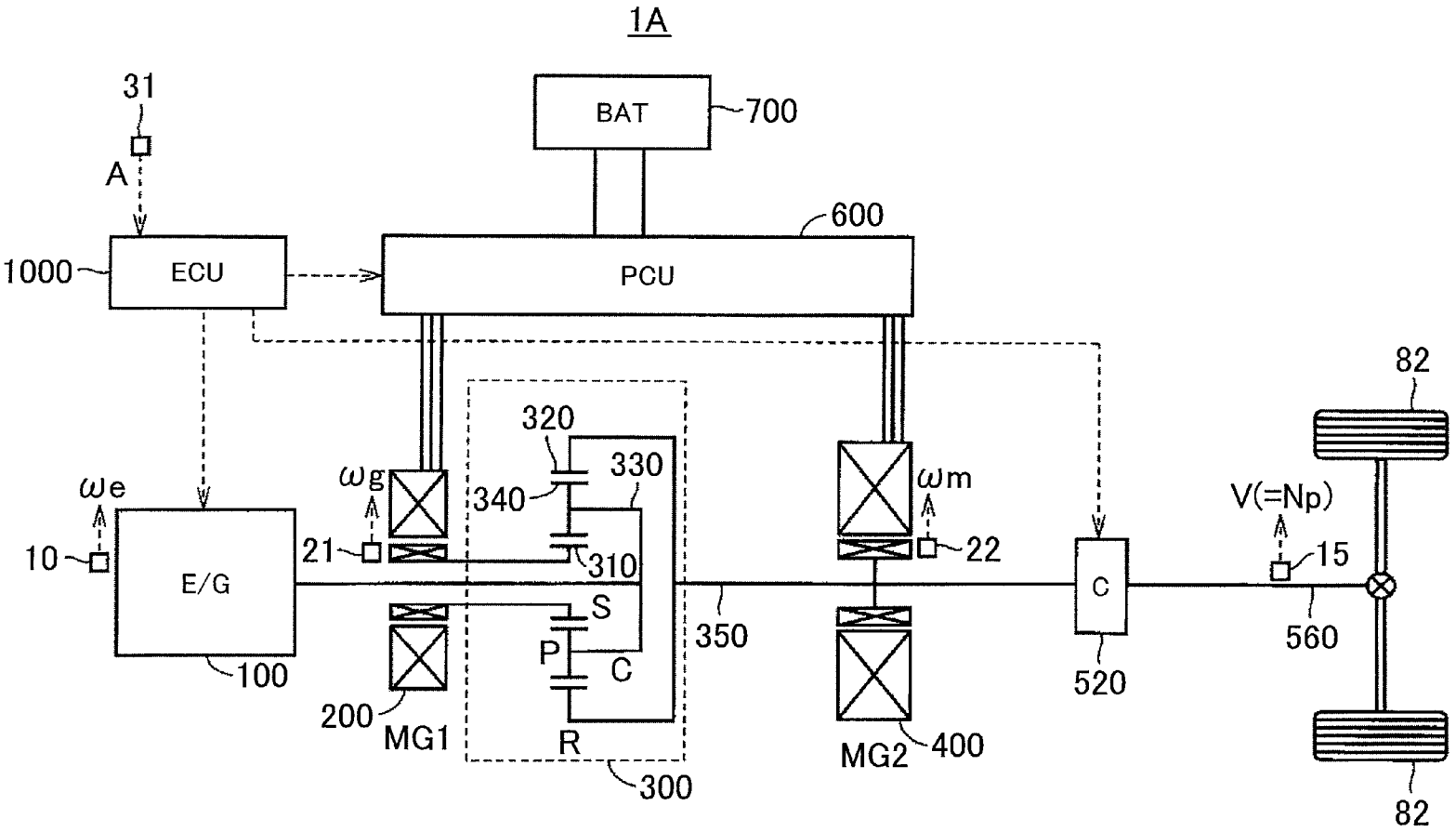
FIG. 11 is a view showing a first modified example of the configuration of the vehicle.

FIG. 11 shows a first modified example of the configuration of the vehicle 1. In the above-described first and second embodiments, the automatic transmission 500 is provided between the power split device 300 and the drive wheels 82. However, a clutch 520 may be provided, in place of the automatic transmission 500, as in a vehicle 1A shown in FIG. 11.

Figure 12:
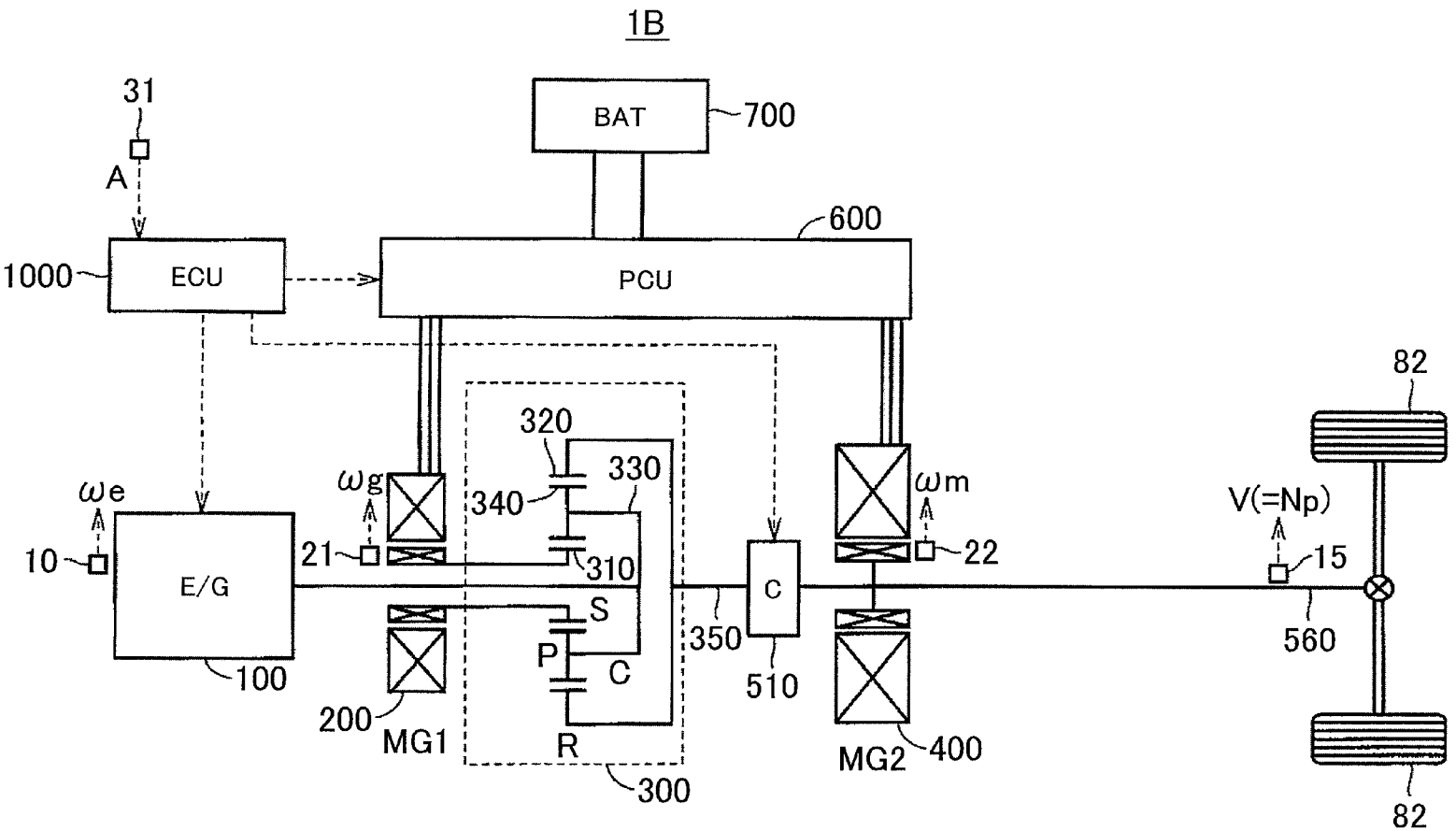
FIG. 12 is a view showing a second modified example of the configuration of the vehicle.

FIG. 12 shows a second modified example of the configuration of the vehicle 1. In the vehicle 1A shown in FIG. 11, the rotor of the second MG 400 is connected to the rotary shaft 350 (that extends between the ring gear (R) 320 and an input shaft of the clutch 520). However, the rotor of the second MG 400 may be connected to the drive shaft 560 (that extends between an output shaft of the clutch 520 and the drive wheels 82), as in a vehicle 1B shown in FIG. 12.

The power split device 300 may be modified provided that it is a differential mechanism having the positive correlation region and the negative correlation region as indicated in FIG. 3 as described above, more specifically, it is a differential mechanism having at least three rotary elements including a first rotary element coupled to the engine 100, and a second rotary element coupled to the drive wheels 82 via the automatic transmission 500 (or clutch 520). Accordingly, the engine 100 is not necessarily connected to the carrier (C) 330, and the automatic transmission 500 is not necessarily connected to the ring gear (R) 320.

Also, the automatic transmission 500 or the clutch 520 is not necessarily provided. Also, the first MG 200 or the second MG 400 is not necessarily provided.

It is to be understood that the illustrated embodiments disclosed herein are merely exemplary in all respects, and not restrictive. The scope of the invention is not defined by the above description of the embodiment, but is defined by the appended claims, and is intended to include all changes within the range of the claims and equivalents thereof.

What is claimed is:

1. A vehicle comprising:

an internal combustion engine configured to generate power for rotating drive wheels;

a differential mechanism provided between the internal combustion engine and the drive wheels, and the differential mechanism having at least three rotary elements including a first rotary element coupled to the internal combustion engine and a second rotary element coupled to the drive wheels; and a controller configured to control the internal combustion engine, the controller being configured to determine whether to perform correction to increase the power generated by the internal combustion engine or perform correction to reduce the power generated by the internal combustion engine, depending on a rotational speed of the second rotary element, when the controller changes a rotational speed of the internal combustion engine, wherein:

there is a positive correlation between a rotational speed of the first rotary element and rotational energy of the differential mechanism, in a first region in which the rotational speed of the second rotary element is lower than a boundary value determined according to the rotational speed of the first rotary element;

there is a negative correlation between the rotational speed of the first rotary element and rotational energy of the differential mechanism, in a second region in which the rotational speed of the second rotary element is higher than the boundary value; and the controller increases the rotational speed of the internal combustion engine by performing correction to increase the power generated when the rotational speed of the second rotary element is included in the first region, and the controller increases the rotational speed of the internal combustion engine by performing correction to reduce the power generated when the rotational speed of the second rotary element is included in the second region; and the controller reduces the rotational speed of the internal combustion engine by performing correction to reduce the power generated when the rotational speed of the second rotary element is included in the first region, and the controller reduces the rotational speed of the internal combustion engine by performing correction to increase the power generated when the rotational speed of the second rotary element is included in the second region.

2. The vehicle according to claim 1, wherein, the controller increases the rotational speed of the internal combustion engine by increasing a correction amount of increase of the power generated as the rotational speed of the second rotary element is lower when the rotational speed of the second rotary element is included in the first region, and the controller increases the rotational speed of the internal combustion engine by setting a correction amount of reduction of the power generated to zero or by increasing the correction amount of reduction of the power as the rotational speed of the second rotary element is higher when the rotational speed of the second rotary element is included in the second region.

3. The vehicle according to claim 1, wherein, the controller reduces the rotational speed of the internal combustion engine by increasing a correction amount of reduction of the power generated as the rotational speed of the second rotary element is lower when the rotational speed of the second rotary element is included in the first region, and the controller reduces the rotational speed of the internal combustion engine by setting a correction amount of increase of the power generated to zero or by increasing the correction amount of increase of the power as the rotational speed of the second rotary element is higher when the rotational speed of the second rotary element is included in the second region.

4. The vehicle according to claim 1, further comprising:

an engagement device provided between the internal combustion engine and the drive wheels, and the engagement device being configured to be placed in a selected one of an engaging state, a slipping state, and a released state, wherein when the engagement device is in the slipping state or the released state and when the controller changes the rotational speed of the internal combustion engine, the controller determines whether to perform correction to increase the power generated by the internal combustion engine or perform correction to reduce the power generated by the internal combustion engine, depending on the rotational speed of the second rotary element.

5. The vehicle according to claim 4, wherein the engagement device is a transmission configured to change a speed ratio.

6. The vehicle according to claim 1, further comprising:

a first rotary electric machine; and a second rotary electric machine, wherein the differential mechanism is a planetary gear mechanism including a sun gear coupled to the first rotary electric machine, a ring gear coupled to the second rotary electric machine, a pinion gear that meshes with the sun gear and the ring gear, and a carrier that holds the pinion gear such that the pinion gear rotates about itself and rotates about an axis of the planetary gear mechanism; and the first rotary element comprises the carrier, and the second rotary element comprises the ring gear.

7. A control method for a vehicle including an internal combustion engine configured to generate power for rotating drive wheels, and a differential mechanism provided between the internal combustion engine and the drive wheels, and the differential mechanism having at least three rotary elements including a first rotary element coupled to the internal combustion engine, and a second rotary element coupled to the drive wheels, the control method comprising:

controlling the internal combustion engine; and determining whether to perform correction to increase the power generated by the internal combustion engine or perform correction to reduce the power generated by the internal combustion engine, depending on a rotational speed of the second rotary element, when changing a rotational speed of the internal combustion engine, wherein:

there is a positive correlation between a rotational speed of the first rotary element and rotational energy of the differential mechanism, in a first region in which the rotational speed of the second rotary element is lower than a boundary value determined according to the rotational speed of the first rotary element;

there is a negative correlation between the rotational speed of the first rotary element and rotational energy of the differential mechanism, in a second region in which the rotational speed of the second rotary element is higher than the boundary value; and the controller increases the rotational speed of the internal combustion engine by performing correction to increase the power generated when the rotational speed of the second rotary element is included in the first region, and the controller increases the rotational speed of the internal combustion engine by performing correction to reduce the power generated when the rotational speed of the second rotary element is included in the second region; and the controller reduces the rotational speed of the internal combustion engine by performing correction to reduce the power generated when the rotational speed of the second rotary element is included in the first region, and the controller reduces the rotational speed of the internal combustion engine by performing correction to increase the power generated when the rotational speed of the second rotary element is included in the second region.

* * * * *